US009643308B2

(12) United States Patent
Ebbesson et al.

(10) Patent No.: US 9,643,308 B2
(45) Date of Patent: May 9, 2017

(54) STAPLER WITH ARRANGEMENT FOR TENSIONING AN ELASTIC MEMBER FORMING PART OF THE STAPLER

(71) Applicant: Isaberg Rapid AB, Hestra (SE)

(72) Inventors: Jan Ebbesson, Asenhoga (SE); Robert Ohlsson, Bredaryd (SE)

(73) Assignee: Isaberg Rapid AB, Hestra (SE)

( * ) Notice: Subject to any disclaimer, the term of this patent is extended or adjusted under 35 U.S.C. 154(b) by 458 days.

(21) Appl. No.: 14/382,316

(22) PCT Filed: Feb. 26, 2013

(86) PCT No.: PCT/SE2013/000028

§ 371 (c)(1),
(2) Date: Aug. 31, 2014

(87) PCT Pub. No.: WO2013/129990

PCT Pub. Date: Sep. 6, 2013

(65) Prior Publication Data

US 2014/0374462 A1 Dec. 25, 2014

(30) Foreign Application Priority Data

Mar. 2, 2012 (SE) ..... 1200135

(51) Int. Cl.
*B25C 7/00* (2006.01)
*B25C 5/11* (2006.01)
*B25C 5/02* (2006.01)

(52) U.S. Cl.
CPC ..... *B25C 5/11* (2013.01); *B25C 5/0242* (2013.01)

(58) Field of Classification Search
CPC ..... B25C 5/11; B25C 1/047
(Continued)

(56) References Cited

U.S. PATENT DOCUMENTS 2,657,384 A 11/1953 Boroughs
2,659,083 A 11/1953 Boroughs
(Continued)

FOREIGN PATENT DOCUMENTS

WO WO 96-38267 A1 12/1996

OTHER PUBLICATIONS

Extended European Search Report issued Sep. 21, 2015, in European Patent Application No. EP13755203.0.

*Primary Examiner* — Robert Long
(74) *Attorney, Agent, or Firm* — Shapiro, Gabor and Rosenberger, PLLC

(57) ABSTRACT

Stapler (1) for driving staples (4) into a workpiece (6), comprising a body (2), an elastic member (7) connected to a driver (9) and an articulated arrangement (12) for tensioning of the member (7) comprising a lever (13) with a long arm (15) and a short arm (16) coupled rotatably to the body by a first coupling shaft (14), an articulated arm (17) coupled rotatably to the body by a second coupling shaft (18) and connected to the member (7) in a force-influencing manner, an intermediate joint (19) with a third coupling shaft (20) assigned rotatably to the short arm (16) at a first distance (a) from the first coupling shaft and assigned rotatably to the articulated arm (17) with a fourth coupling shaft (21) at a second distance (b) from the third coupling shaft (20), the first distance has the distance line (a) and the second distance has the distance line (β), which form the angle (γ) between themselves, the member (7) is tensioned in that the lever (13) is rotated (N) about coupling shaft (14) from a starting position to an end position, due to which the lever via the intermediate joint causes the articulated arm to rotate (R) about the coupling shaft and tension the member (7) by guiding this from a first neutral untensioned position to a
(Continued)

second tensioned position, wherein the first distance (a) is 1.2-1.6 times greater than the second distance (b).

12 Claims, 7 Drawing Sheets

(58) Field of Classification Search
USPC ..... 227/119–134, 140, 146, 154, 155
See application file for complete search history.

(56) References Cited

U.S. PATENT DOCUMENTS 2,671,215 A 3/1954 Abrams
4,572,419 A * 2/1986 Klaus ..... B25C 5/15 227/120
5,890,642 A * 4/1999 Sato ..... A61B 17/1227 227/120
5,979,736 A * 11/1999 Edeholt ..... B25C 5/11 227/132
5,988,478 A * 11/1999 Marks ..... B25C 5/1696 227/132
6,789,719 B2 * 9/2004 Shor ..... B25C 5/11 227/120
7,097,088 B2 8/2006 Shor
7,140,526 B2 * 11/2006 Matsukawa ..... B25C 5/0242 227/120
7,604,149 B2 * 10/2009 Tsai ..... B25C 5/0242 227/132
7,637,407 B2 * 12/2009 Shor ..... B25C 5/11 227/120
7,644,849 B2 * 1/2010 Tsai ..... B25C 5/11 227/129
8,356,739 B2 * 1/2013 Huang ..... B25C 5/025 227/107
2004/0084504 A1 5/2004 Shor
2007/0023474 A1 * 2/2007 Smith ..... B25C 5/0207 227/155
2007/0175946 A1 * 8/2007 Marks ..... B25C 5/11 227/132
2007/0257080 A1 * 11/2007 Kamins ..... B25C 5/10 227/132
2008/0302850 A1 * 12/2008 Kumayama ..... B25C 5/0242 227/120
2009/0184150 A1 * 7/2009 Tsai ..... B25C 5/0221 227/134
2010/0314431 A1 * 12/2010 Wang ..... B25C 5/11 227/120
2011/0089217 A1 4/2011 Chen
2013/0001269 A1 * 1/2013 Aoki ..... B25C 5/0207 227/155
2013/0181028 A1 * 7/2013 Wu ..... B25C 5/1658 227/109
2014/0042203 A1 * 2/2014 Abe ..... B25C 5/1603 227/120
2014/0284369 A1 * 9/2014 Yang ..... B25C 5/11 227/132
2015/0273675 A1 * 10/2015 Ebbesson ..... B25C 5/11 227/146

* cited by examiner

F
D
P1
P2
P3
H

STAPLER WITH ARRANGEMENT FOR TENSIONING AN ELASTIC MEMBER FORMING PART OF THE STAPLER

TECHNICAL FIELD

The present invention relates to a stapler for driving staples into a workpiece, which stapler comprises a body, which has a staple magazine for storing said staples, a driver, an elastic member connected to the driver and an articulated arrangement for tensioning of the elastic member, which articulated arrangement comprises a lever, which is coupled to the body rotatably via a first coupling shaft and which has a long arm and a short arm, an articulated arm, which is coupled to the body rotatably via a second coupling shaft and is connected to the elastic member in a force-influencing manner, and an intermediate joint, which is assigned rotatably via a third coupling shaft to the short arm of the lever at a first distance from the first coupling shaft and assigned rotatably with a fourth coupling shaft to the articulated arm at a second distance from the third coupling shaft, wherein the first distance has a first distance line and the second distance has a second distance line, which lines form an angle between themselves and where tensioning of the elastic member takes place in that the lever is rotated about its coupling shaft from a start position to an end position, during which rotation the lever via the intermediate joint causes the articulated arm to rotate about its coupling shaft and thereby tension the elastic member by guiding this from a first position, in which it is in a neutral state, to a second position, in which it is tensioned.

PRIOR ART

Staplers with an arrangement of the kind specified above are previously known. Such an arrangement is basically shown, for example, in U.S. Pat. No. 2,657,384. Other patent specifications that comprise arrangements with basically the same configuration are shown in U.S. Pat. No. 7,097,088 and U.S. Pat. No. 2,671,215.

Disadvantages of Previous Arrangements

The elastic member that forms part of the present invention and of previous arrangements is arranged so that it is required that the force that is applied to the member must increase linearly according to the extent of increasing tensioning. The increase in force must thus take place in a linear manner and the diagram in FIG. 1 shows how this linear increase takes place. The vertical scale F shows the force that is produced in the elastic member and the horizontal scale D shows the deformation of the elastic member that occurs when this is tensioned, and the linear relationship between force and deformation is shown by the straight line in the diagram.

When a normal user clenches his fist, this produces a force that has the appearance shown by the curved line H in the diagram in FIG. 1. In this case, the vertical axis shows the force that is produced and the horizontal axis shows how great the movement executed by the hand is. As is shown from this, the increase in force does not take place in an entirely linear manner.

This difference between the linear increase in force that is shown in FIG. 1 by the straight line and the increase in force that is shown by the curved line H in FIG. 1 means that the arrangement should be configured so that a synchronisation occurs between the production of force of the hand and the production of force that is required to tension the elastic member. However, only a very limited synchronisation of this kind takes place in previous arrangements.

Problem

There is thus a requirement for an arrangement that synchronises the force that is produced by the hand of a normal user and the force that is required to tension the elastic member.

Solution to the Problem

The invention now proposed provides an arrangement that achieves a solution of the problem specified with an arrangement of the type indicated in the introduction, which is characterised by that the first distance is 1.2-1.6 times greater than the second distance. The invention is further characterised by that the first distance is 1.3-1.5 times greater than the second distance.

Furthermore, the invention is characterised by that the first distance is 1.4 times greater than the second distance.

Moreover, the invention is characterised by that the angle between the distance lines before tensioning is commenced is 58°-68°.

Furthermore, the present invention is characterised by that said angle is 61°-65°.

Finally, the present invention is characterised by that said angle is 63°.

BRIEF DESCRIPTION OF FIGURES

The invention shall be described below with reference to the enclosed figures, in which.

PREFERRED EMBODIMENT

Figure 2:
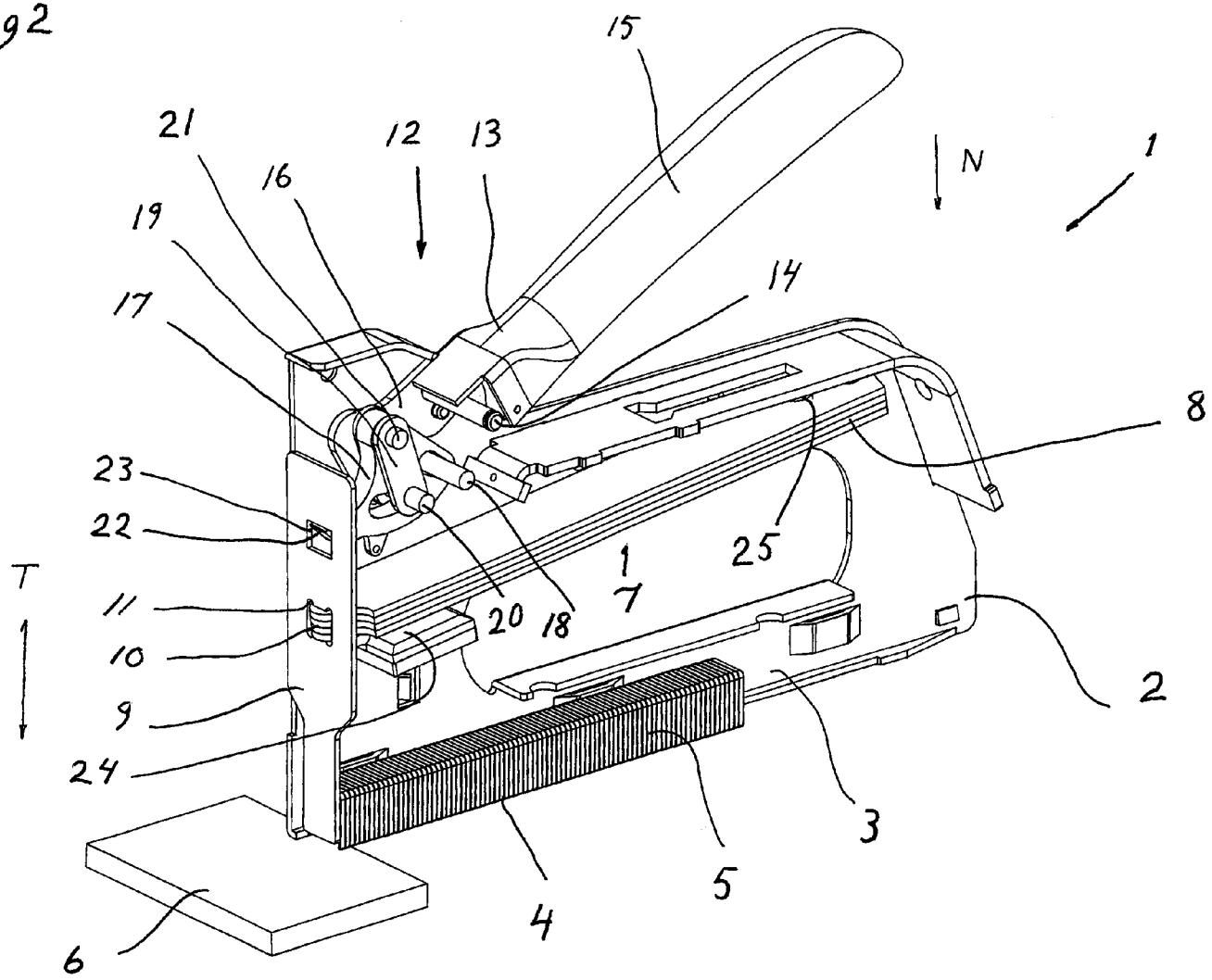
FIG. 2 is a view that shows a stapler according to the present invention, in which the side facing the viewer has been rendered transparent. In the view, the elastic member is in an untensioned state.

FIG. 2 shows a stapler 1, which is equipped with the present invention. The side that is facing the viewer is not shown in the figure. As is clear from the figure, the stapler comprises a body 2. The body has a magazine 3 in which staples 4 are stored in the form of a staple stack 5, which are intended to be driven into a workpiece 6. An elastic member 7 in the form of a plate spring 8 is also arranged in the body. The plate spring is connected to a driver 9, which is supported in a sliding manner in the body 2 in such a way that it can be guided up and down in the movement shown by the double arrow T. The support is not evident from the figures, but it is obvious to the person skilled in the art, which is why it is not described further. The connection of the plate spring to the driver is achieved by a tongue 10 arranged on the plate spring, which tongue engages in a first opening 11 arranged on the driver. An articulated arrangement 12 is also assigned to the body, which arrangement comprises a lever 13, which is assigned rotatably to the body 2 with a first coupling shaft 14, the lever comprises a long arm 15 and a short arm 16, an articulated arm 17, which is assigned rotatably to the body 2 with a second coupling shaft 18, and an intermediate joint 19, which is coupled rotatably by a third coupling shaft 20 to the short arm of the lever and coupled rotatably to the articulated arm 17 by a fourth coupling shaft 21. It is further evident from the figure that the articulated arm 17 has an engagement member 22, which is in engagement with a second opening 23 in the driver 9. A plate 24 is also assigned to the body 2, against which plate the plate spring 8 rests when the plate spring is not tensioned by the articulated arrangement.

Figure 3:
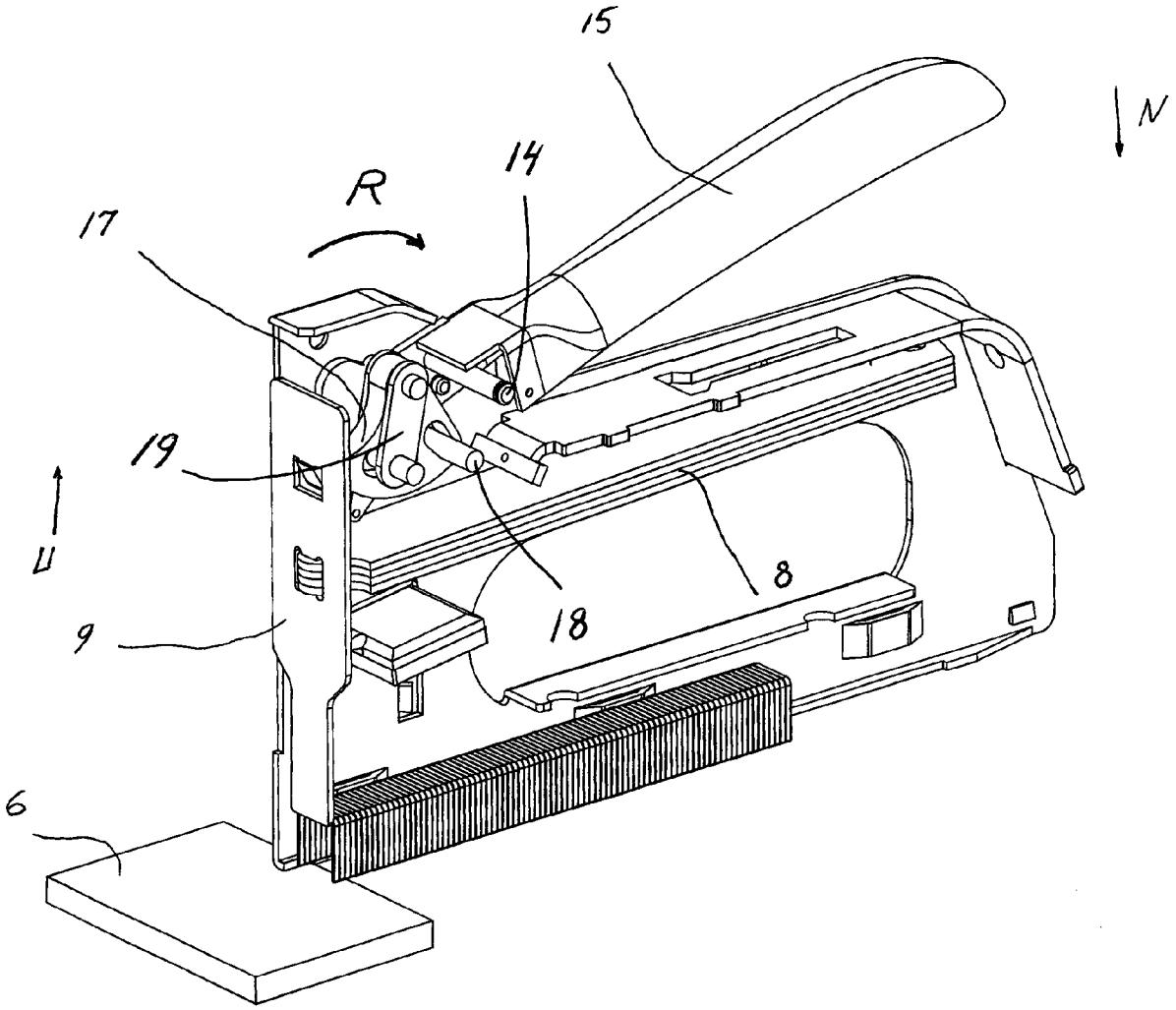
FIG. 3 is a view corresponding to FIG. 2, in which the elastic member is partly tensioned.
Figure 4:
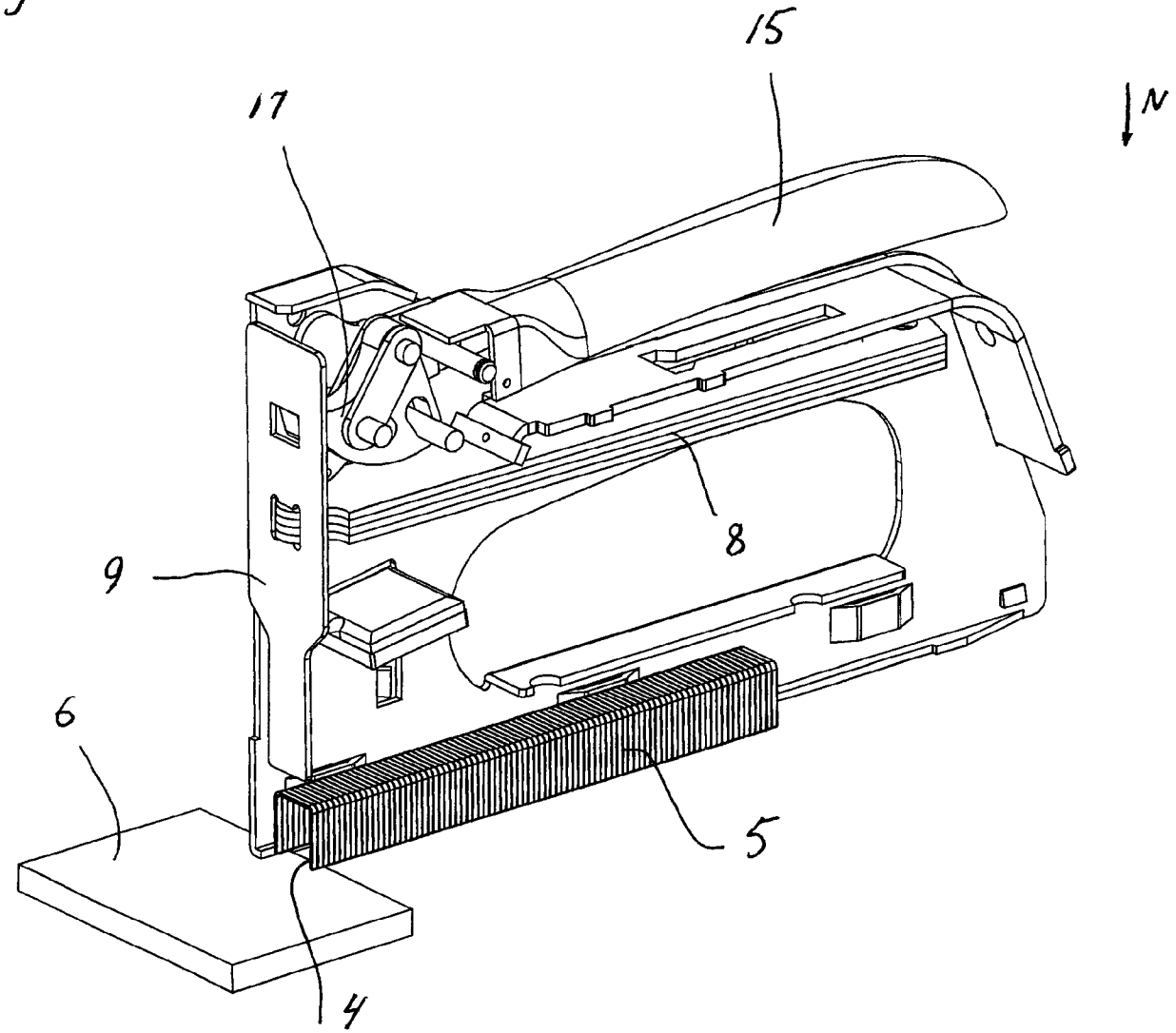
FIG. 4 is a view corresponding to FIG. 2 in which the elastic member is fully tensioned.

The function of the invention shall be described generally below with reference to FIGS. 2-4. In FIG. 2, the stapler is in a starting position placed against a workpiece 6, into which a staple is to be driven. The driver 9 is in its starting position and the plate spring 8 is not tensioned. The plate spring 8 is fixed to the body by a screw 25, which is not clearly visible from the figures, but the attachment is obvious to the expert, which is why it is not described further herein. The long arm 15 extends out from the body 2 and the articulated arm 17 has a force connection to the plate spring 8 through its engagement member and the driver. In FIG. 3, the long arm 15 has been rotated in the direction N down towards the body 2 and thus rotated about the first coupling shaft 14, which means that the joint 19 has guided the articulated arm 17 in the direction shown by the arrow R in the figure, which means that the engagement member 22 has lifted the driver 9 upwards in the direction shown by the arrow U. This upward movement of the driver means that the plate spring 8 has been tensioned. In FIG. 4, the arm 15 has been moved further down towards the body and a further tensioning of the plate spring has taken place. In the position shown in FIG. 4, the driver is in the position from which it is released and moved downwards by the force of the plate spring and hits the front staple 4 in the staple stack 5. The release of the driver takes place in that the engagement member is released from the driver. This can take place in different ways, but as this function does not form part of the invention now in question and as it can happen in several ways known to the expert, it is not described further here.

Figure 6:
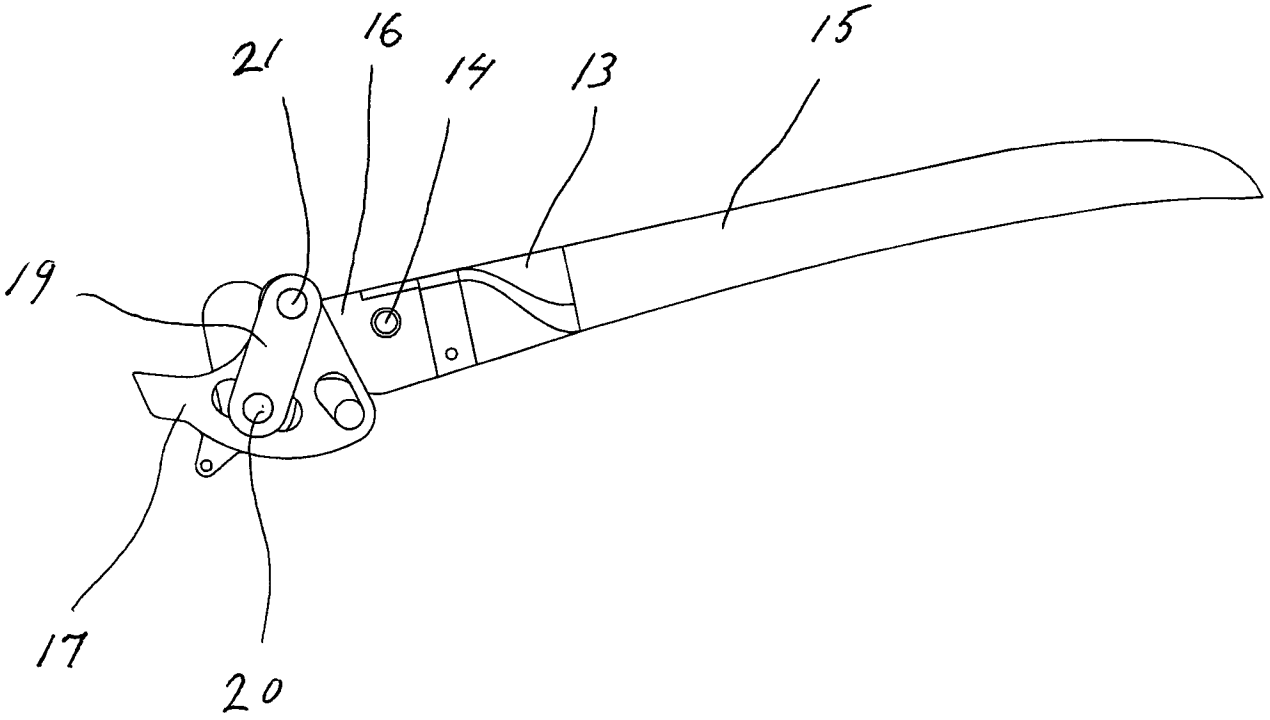
FIG. 6 is a view corresponding to FIG. 5, in which the arrangement is in the position shown in FIG. 3.
Figure 7:
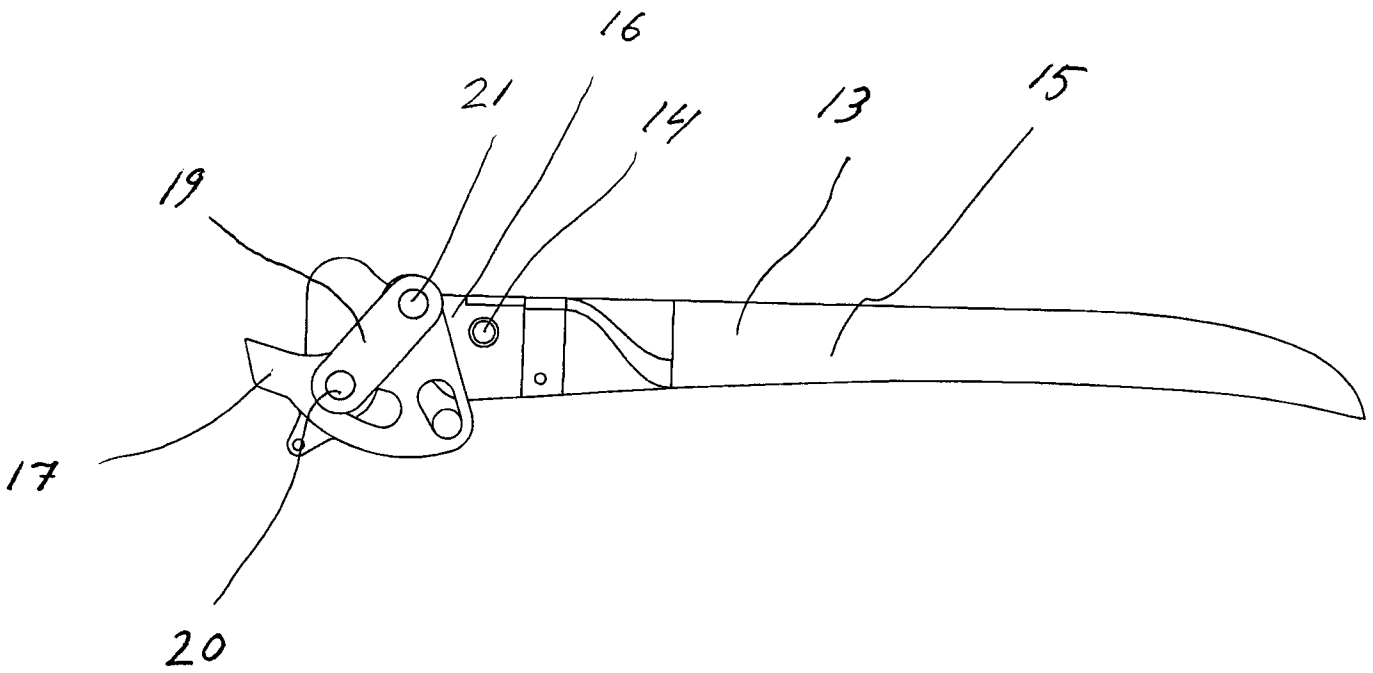
FIG. 7 is a view corresponding to FIG. 5, in which the arrangement is in the position shown in FIG. 4.

The articulated arrangement and its function shall be described in detail with reference to FIGS. 5-7. It is evident from the figures that the lever 13 is supported rotatably about the first coupling shaft 14. The arm 13 is divided into a long arm 15 and a short arm 16. In the short arm 16, the joint 19 is supported with a third coupling shaft 20 at a defined distance a from the first coupling shaft 14. The joint 19 is further coupled by a fourth coupling shaft 21 to the articulation 17 at a defined distance b from the third coupling shaft 20. A first distance line $\alpha$ extends between the first coupling shaft 14 and the third coupling shaft 20 and a second distance line $\beta$ extends between the fourth coupling shaft 21 and the third coupling shaft 20. These distance lines form an angle $\gamma$ between them.

Figure 5:
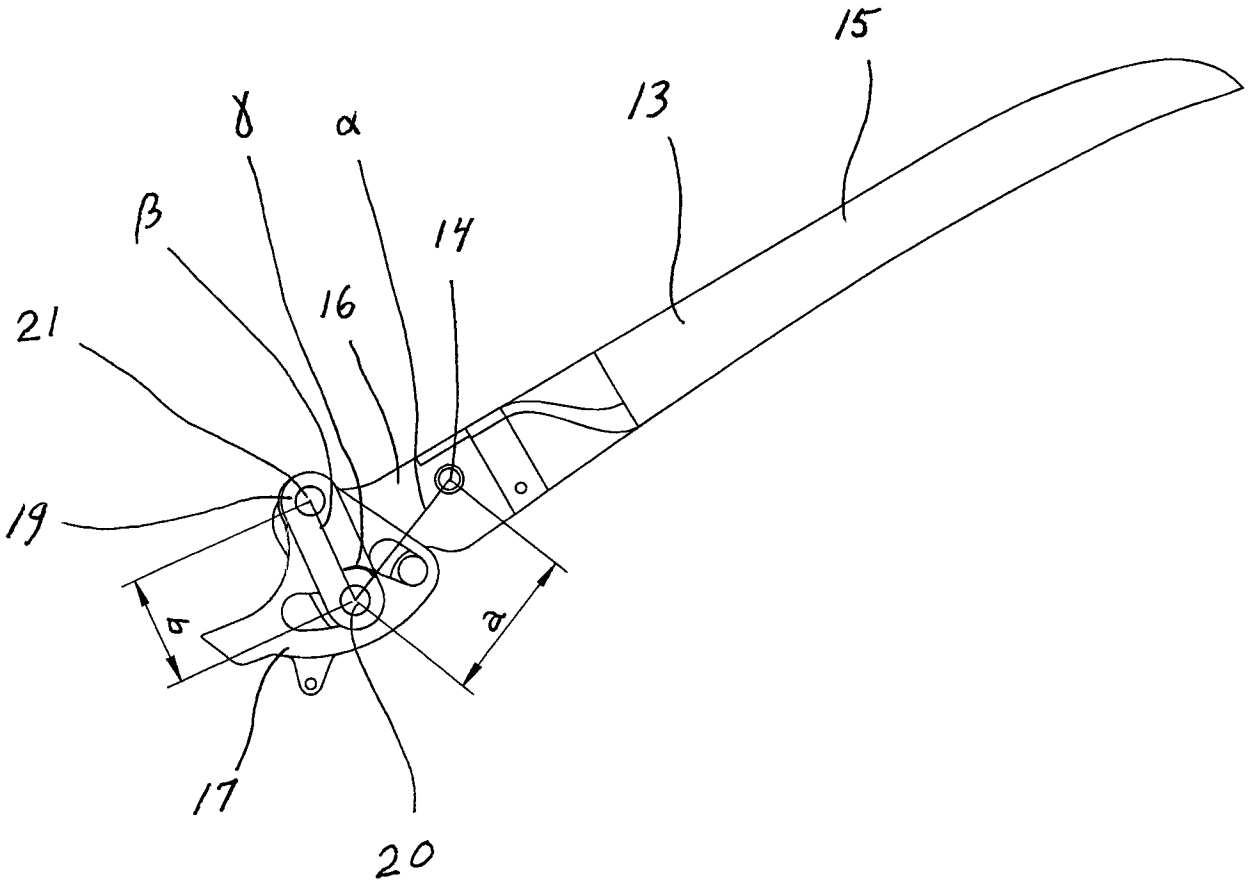
FIG. 5 is a view in detail of the articulated arrangement forming part of the invention, in which the arrangement is in the position shown in FIG. 2.

When the articulated arrangement is in the position shown in FIGS. 2 and 5, the arrangement is in a starting position and the plate spring is not tensioned. In this position there is no relation between the force that is produced in the plate spring and the deformation that the spring is exposed to when it is tensioned, as the plate spring has not been tensioned. A point P1 on the straight line that is shown in figure one is located far down to the left in the diagram, therefore. In FIGS. 3 and 6, the handle has been rotated towards the body and the driver has been moved upwards, which means that the plate spring has been tensioned and the relation between the force F and the deformation D of the plate spring is such that a point showing this relation in the diagram is located at point P2. In FIGS. 4 and 7, the arm has been moved to its end position and the relation between the force F and the deformation of the plate spring is then such that the point showing this relation is located in the position shown by P3 in the diagram.

Figure 1:
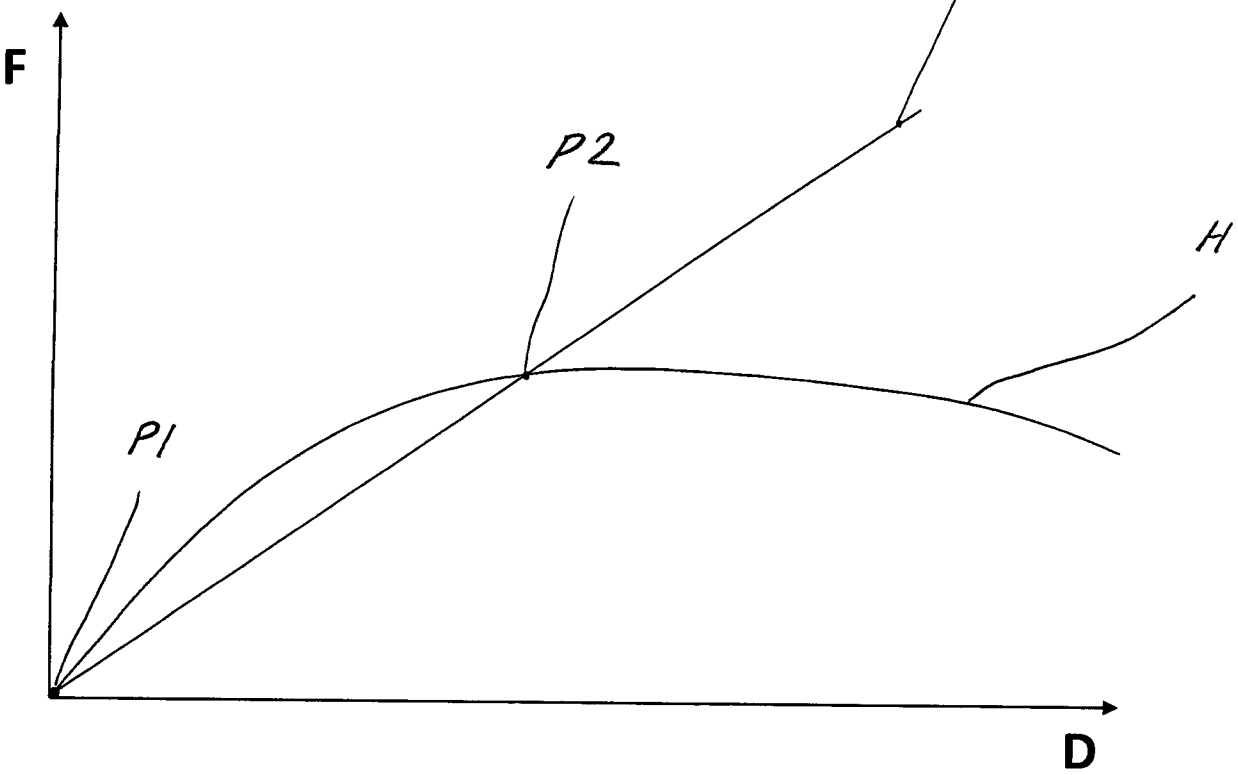
FIG. 1 is a diagram showing the connection between the increase in force in the elastic member and the deformation of the elastic member that occurs on the one hand, and the connection between the force produced by a normal user depending on how tightly he closes his hand.

Since the force that a normal user produces when he clenches his fist has an appearance such as is shown by the curve H in the diagram in FIG. 1, it is, if the force of the hand shall be utilised best, necessary that a change take place between the rotation of the arm 15 and the rotation of the articulated arm 17.

By coupling the arm 13 to the articulation 17 by an intermediate joint 19 and by dimensioning the distance a and b so that the first distance a is 1.2-1.6 times greater than the second distance b, an advantageous change is obtained. The change becomes more advantageous if said relation is made 1.3-1.5, and it has proved most advantageous to make the relation 1.4.

However, not only the relation between the given distances creates the optimum change, but the angle $\gamma$ when the elastic member is not tensioned and the engagement organ of the articulated arm 17 is in initial contact with the driver is also of great importance. An advantageous change is obtained by keeping this angle at 58°-68°. The change becomes even more advantageous if the angle is kept at 61°-65° and the change becomes most advantageous if the angle is kept at 63°.

The invention is not restricted by the above description, but is restricted only by the following claims.

The invention claimed is:

1. Stapler for driving staples into a workpiece, which stapler comprises a body, which has a staple magazine for storing said staples, a driver, an elastic member connected to the driver and an articulated arrangement for tensioning of the elastic member, which articulated arrangement comprises a lever, which is coupled rotatably to the body via a first coupling shaft and which has a long arm and a short arm, an articulated arm, which is coupled rotatably to the body via a second coupling shaft and is connected to the elastic member in a force-influencing manner, and an intermediate joint, which is coupled rotatably to the short arm of the lever via a third coupling shaft at a first distance from the first coupling shaft and coupled rotatably to the articulated arm with a fourth coupling shaft at a second distance from the third coupling shaft, wherein the first distance has a first distance line and the second distance has a second distance line, which lines form an angle between themselves and where the tensioning of the elastic member takes place in that the lever is rotated about its coupling shaft from a starting position to an end position, during which rotation the lever via the intermediate joint causes the articulated arm to rotate about its coupling shaft and thereby tension the elastic member by guiding this from a first position, in which it is in a neutral state, to a second position, in which it is tensioned, wherein the first distance is 1.2-1.6 times greater than the second distance.

2. Stapler according to claim 1, wherein the first distance is 1.3-1.5 times greater than the second distance.

3. Stapler according to claim 1, wherein the first distance is 1.4 times greater than the second distance.

4. Stapler according to claim 1, wherein the angle before the lever is rotated from the position in which the engagement member of the articulated arm is in initial contact with the driver is 58°-68°.

5. Stapler according to claim 1, wherein the angle before the lever is rotated from the position in which the engagement member of the articulated arm is in initial contact with the driver is 61°-65°.

6. Stapler according to claim 1, wherein the angle before the lever is rotated from the position in which the engagement member of the articulated arm is in initial contact with the driver is 63°.

7. Stapler according to claim 2, wherein the angle before the lever is rotated from the position in which the engagement member of the articulated arm is in initial contact with the driver is 58°-68°.

8. Stapler according to claim 2, wherein the angle before the lever is rotated from the position in which the engagement member of the articulated arm is in initial contact with the driver is 61°-65°.

9. Stapler according to claim 2, wherein the angle before the lever is rotated from the position in which the engagement member of the articulated arm is in initial contact with the driver is 63°.

10. Stapler according to claim 3, wherein the angle before the lever is rotated from the position in which the engagement member of the articulated arm is in initial contact with the driver is 58°-68°.

11. Stapler according to claim 3, wherein the angle before the lever is rotated from the position in which the engagement member of the articulated arm is in initial contact with the driver is 61°-65°.

12. Stapler according to claim 3, wherein the angle before the lever is rotated from the position in which the engagement member of the articulated arm is in initial contact with the driver is 63°.

* * * * *